US006357209B1

(12) United States Patent
Mossbeck et al.

(10) Patent No.: US 6,357,209 B1
(45) Date of Patent: Mar. 19, 2002

(54) METHOD OF PACKAGING SPRINGS

(75) Inventors: Niels S. Mossbeck; Thomas J. Wells, both of Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/710,392

(22) Filed: Nov. 9, 2000

Related U.S. Application Data

(63) Continuation of application No. 09/397,337, filed on Sep. 15, 1999.

(51) Int. Cl.[7] ..... B65B 63/04

(52) U.S. Cl. ..... 53/430; 53/114; 53/118; 29/91.1

(58) Field of Search ..... 53/430, 383.1, 53/376.5, 118, 14; 5/654.1, 739, 685.7, 721; 29/91.1, 91.5, 91.6

(56) References Cited

U.S. PATENT DOCUMENTS

| | | | |
|---|---|---|---|
| 1,643,091 | A | 9/1927 | Rosenthal et al. |
| 1,685,851 | A | 10/1928 | MacInerney |
| 1,898,573 | A | 2/1933 | Schubert |
| 2,114,008 | A | 4/1938 | Wunderlich |
| 2,129,038 | A | 9/1938 | Schob |
| 2,193,410 | A | 3/1940 | Schubert |
| 2,247,543 | A | 7/1941 | Bernstein |
| 3,111,690 | A | 11/1963 | Tarlow |
| 3,200,418 | A | 8/1965 | Lebens |
| 3,325,833 | A | 6/1967 | Withoff |
| 3,576,040 | A | 4/1971 | Larsen |
| 3,579,774 | A | 5/1971 | Shreve |
| 3,813,843 | A | 6/1974 | Wooldridge et al. |
| 4,194,255 | A | 3/1980 | Poppe |
| 4,244,089 | A | 1/1981 | Cavaler |
| 4,602,471 | A | 7/1986 | Gray et al. |
| 4,669,247 | A | 6/1987 | Woffendin |
| 4,711,067 | A | 12/1987 | Magni |
| 4,995,162 | A | 2/1991 | Beteré Cabeza |
| 5,432,964 | A | 7/1995 | Strell |
| 5,438,718 | A | 8/1995 | Kelly et al. |
| 5,761,784 | A | 6/1998 | Ogle et al. |

*Primary Examiner*—Scott A. Smith
*Assistant Examiner*—Christopher Harmon
(74) *Attorney, Agent, or Firm*—Wood, Herron & Evans, L.L.P.

(57) ABSTRACT

A method of packaging spring units in which first and second webs of insulator material are fixedly located against the top and bottom surfaces of the spring units. The webs are folded around outermost coil springs along longitudinal edges of the spring units. The reverse sides of the webs are glued, welded or otherwise permanently secured together. In another embodiment, side portions of the webs are secured together, sandwiching the spring units therebetween. The resultant bedding products are then roll-packed.

24 Claims, 4 Drawing Sheets

METHOD OF PACKAGING SPRINGS

CROSS REFERENCE TO RELATED APPLICATION

This patent application is a continuation application of U.S. patent application Ser. No. 09/397,337 filed Sep. 15, 1999 entitled METHOD OF PACKAGING SPRINGS AND RESULTING PACKAGED PRODUCT, which is fully incorporated by reference herein.

FIELD OF THE INVENTION

This invention relates to the packaging of spring units. More specifically, this invention relates to a method of roll-packing plural spring units.

BACKGROUND OF THE INVENTION

It is known in the art to pack spring units for use in making mattresses by winding a length of flexible web material, e.g., disposable paper or re-usable hessian around a mandrel and feeding the spring units successively into the nip between the growing roll and the traveling web material. The spring units are compressed as they are drawn into the roll, and the result is that the roll-packed springs have a much reduced volume as compared to conventionally stacked spring units.

One type of machine known for this purpose has a winding mandrel to which a holding bar is bolted by its ends for holding the leading end of a packing web material. An upwardly moveable pressure roller is mounted above the mandrel so as to define therewith an entry nip for the web material. The web material is fed from a reel supported at the rear of the machine over the pressure roller and on to the mandrel. An operator standing at the front of the machine feeds springs into the entry nip.

Another machine for packing bedding springs is seen in U.S. Pat. No. 4,669,247. This patent describes packing spring units into a roll with a web of paper or other reusable material. A similar spring packing machine is seen in U.S. Pat. No. 2,114,008, in which a roll of wrapping paper is fed along a table and into a wrapping mechanism whereat spring assemblies are placed upon the paper and fed into the machine by the paper movement.

All of these prior art machines compress and wrap springs in a single web of paper or reusable material which separates the multiple layers of spring units in a roll and maintains the springs in a compressed state for shipment from a spring manufacturer to a mattress manufacturer. This conventional roll-packing technique tends to be expensive. Either large amounts of paper that will be eventually disposed of are used to wrap springs at a cost to the spring manufacturer which is often passed on to the mattress manufacturer, or much more expensive recyclable packaging is used to roll and ship springs. The recyclable material which is used to roll and ship springs must be thereafter shipped back to the spring manufacturer who, again, may incur the cost of shipping back the material and may pass that expense on to the mattress manufacturer. In addition, recyclable spring packaging material has a relatively short life span, albeit longer than paper packaging.

Therefore, it has been one objective of the present invention to reduce the cost of packaging and shipment of spring units.

It has been another objective of the present invention to provide a method of packaging spring units without using conventional paper or reusable packaging methods.

It has been a further objective of the present invention to provide a method of packaging a spring unit in which the spring unit is packaged in insulator material that will not be disposed of but, rather, be used by the mattress manufacturer in mattress production.

SUMMARY OF THE INVENTION

The preferred embodiments of the present invention accomplish these objectives with a method of packaging a resilient spring unit such as a plurality of interconnected coil springs in which first and second webs of spring insulator material are first attached to the spring unit so as to be located against the spring unit top and bottom surfaces and thereafter roll-packed for shipment from a spring manufacturer to a mattress manufacturer who simply unrolls the spring units and cuts the insulator material between the spring units, the spring units having the insulator material attached thereto to be used in mattress manufacture so as to eliminate the need to roll-pack the spring units with disposable paper or expensive reusable material.

The spring unit has a uniform depth defined by a generally planar top first surface and a parallel generally planar bottom second surface. The spring unit has a longitudinal dimension or length defined by a pair of opposed parallel end surfaces and a transverse dimension or width defined by a pair of opposed parallel side surfaces. The longitudinal dimension or length is generally greater than the transverse dimension or width of the spring unit as in most bedding products. However, a square spring unit in which the longitudinal and transverse dimensions are equal may also be packaged using this inventive method.

The method of the present invention comprises providing first and second web rolls of insulator material spaced from one another. The first web roll comprises a first web of spring insulator material, e.g., woven or non-woven material, wound about a core. Similarly, the second web roll comprises a second web of spring insulator material wound about a core.

Each of the first and second webs of insulator material have a pair of opposed side edges defining a width of the web which is wider than the spring unit's transverse dimension. Each web across its width has a pair of opposed side portions and a central portion between the side portions.

The first web of insulator material is passed over and located against the first surface of the spring unit, and the second web is passed under and located against the second surface of the spring unit. The longitudinal dimension of the spring unit is generally parallel to the opposed side edges of the first and second webs which are generally parallel to one another.

In a first preferred embodiment, the first and second webs are folded back upon themselves around the top and bottom turns of the edgemost coil springs of the spring unit so that the opposed side portions are located against the surface of the central portion located against the spring unit. These side portions are then bonded, welded or otherwise secured to the central portion. In a second preferred embodiment, the side portions of the first web are bonded or welded to the adjacent side portions of the second web so as to form a tight fitting sleeve in which the spring unit is securely located. The spring unit with the first and second webs secured there against constitutes a bedding product.

The final step in the method of the present invention is to draw the bedding product into a roll-packing machine in which the bedding product is compressed and rolled onto a dowel whereafter the bedding product is maintained in this rolled and compressed state for shipment to a mattress manufacturer.

These and other objectives and advantages of this invention will be readily apparent from the following description of the drawings.

DETAILED DESCRIPTION OF THE PREFERRED EMBODIMENT

Figure 1:
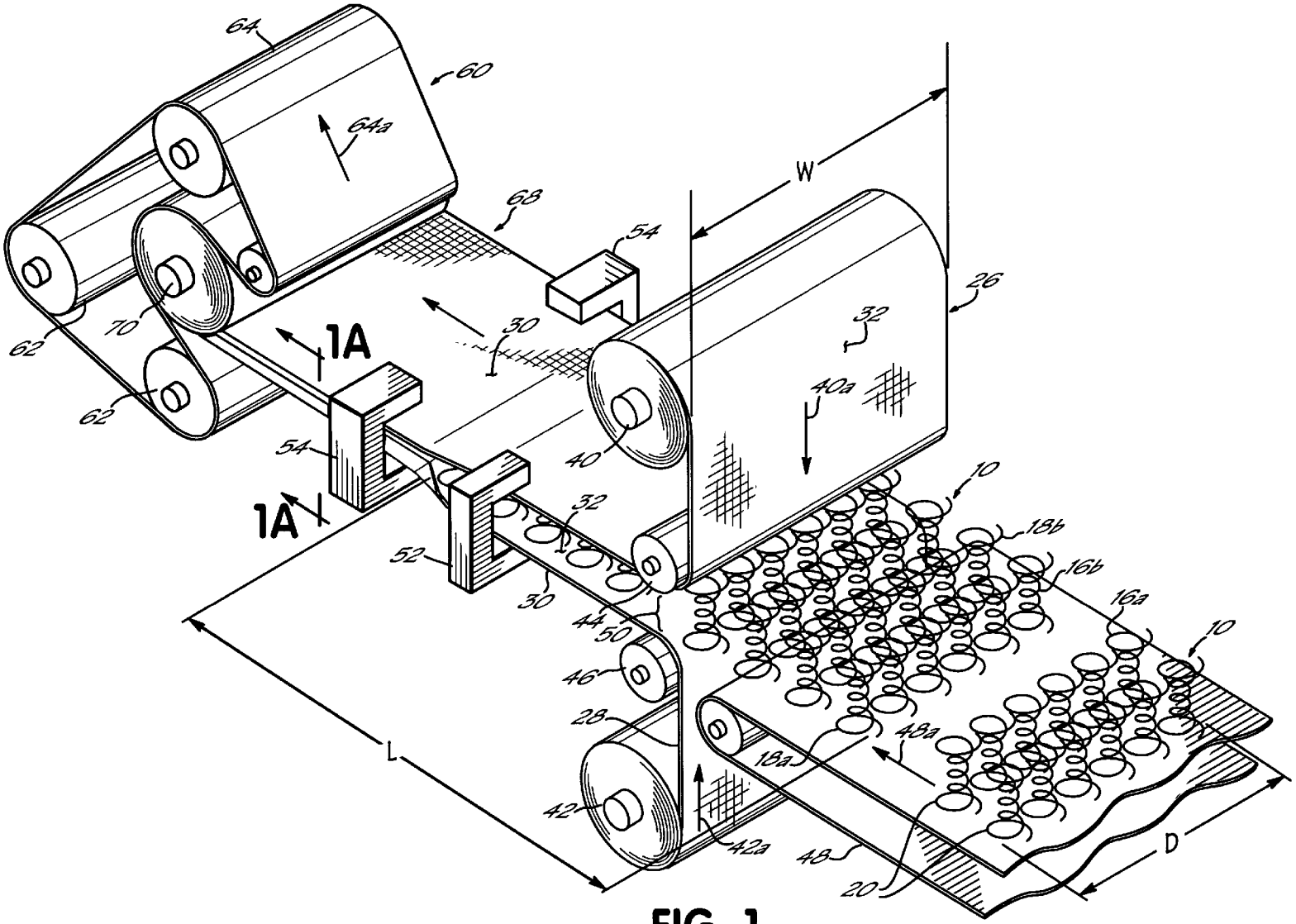
FIG. 1 is a perspective view of a first preferred embodiment of the present inventive method of packaging a resilient spring unit.

As can be seen generally in FIGS. 1, 1A, 3, 3A, a spring unit 10 generally has a top or first surface 12 and a bottom or second surface 14. The spring unit 10 has a length or a longitudinal dimension L and a width or a transverse dimension D, the longitudinal dimension L being generally larger than the transverse dimension D. However, it will be appreciated by those in the art that L may be substantially similar to D in dimension. The spring unit 10 has a thickness T between the first surface 12 and the second surface 14 which defines opposing end surfaces 16*a*, 16*b* and opposing side surfaces 18*a*, 18*b*.

The spring unit 10 is generally comprised of a plurality of coil springs 20, the coil springs 20 being secured one to another by means generally known in the art. Each coil spring 20 has a top turn 22 comprising a portion of the first surface 12 and a bottom turn 24 comprising a portion of the second surface 14.

The first surface 12 and the second surface 14 are covered with first and second webs 26, 28, respectively, of insulator material. The insulator material used to cover the first and second surfaces 12, 14 of the spring unit 10 is generally a woven or non-woven material. Each of the first and second webs 26, 28 have an obverse side or outer surface 30 and a reverse or inner surface 32, the or inner surface 32 of each of the first and second webs 26, 28 being located against the first and second surfaces 12, 14 of the spring unit 10, respectively.

Figure 1A:
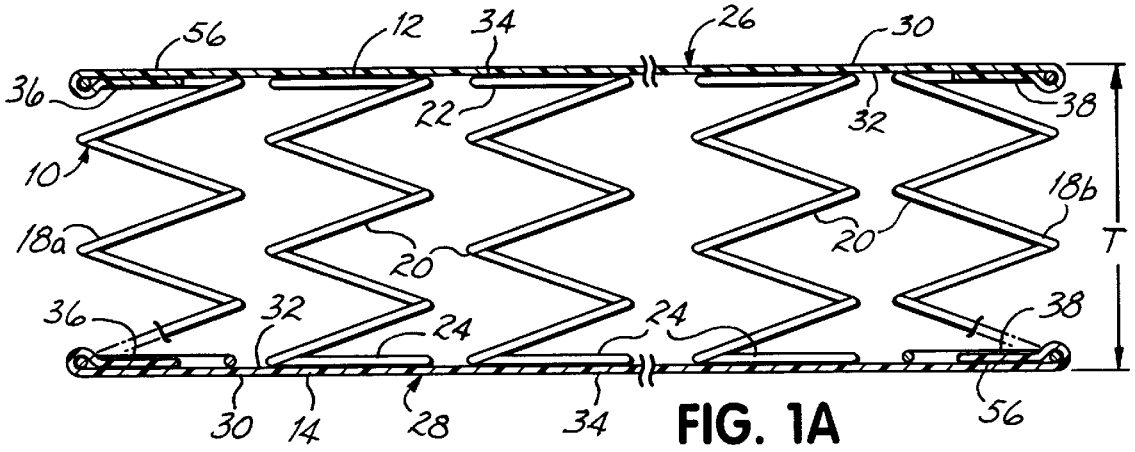
FIG. 1A is a cross-sectional view taken along line 1A—1A of FIG. 1.
Figure 3A:
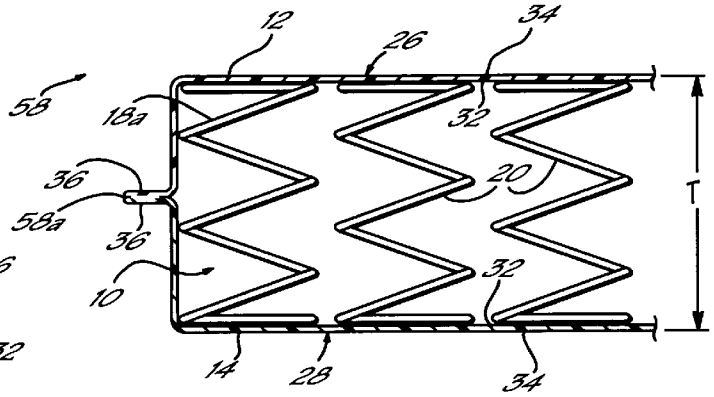
FIG. 3A is a cross-sectional view taken along line 3A—3A of FIG. 3.

As seen in FIGS. 1A and 3A, each of the first and second webs 20 26, 28 has a center portion 34 and opposed side portions 36, 38. Each of the first and second webs 26, 28 has a substantially similar width W larger than the transverse dimension D of the spring unit 10 so that the opposed side portions 36, 38 generally extend beyond the transverse dimension D of the spring unit 10 in substantially equal amounts. The lengths (not indicated) of the first and second webs 26, 28 are considerably longer than the longitudinal dimension L of a single spring unit 10 so that plural spring units 10 may be packaged by the inventive method described in further detail below.

In the present inventive method of packaging a spring unit 10, the first and second webs 26, 28 are carried upon respective first and second cores 40, 42 which allow the first and second webs 26, 28 to be drawn therefrom in reverse directions as indicated by directional arrows 40*a*, 42*a*. The first and second webs 26, 28 are drawn between respective first and second guide rollers 44, 46, the rollers 44, 46 being spaced apart from each other so that spring unit 10 may be received therebetween. A conveyor 48 transports the spring unit 10 by directional arrow 48*a* into a space 50 defined between the first and second rollers 44, 46 whereat the first and second webs 26, 28 are passed over and under and located against the first and second surfaces 12, 14, respectively, of the spring unit 10.

In a first preferred embodiment, after the first and second webs 26, 28 are located against the respective first and second surfaces 12, 14 of the spring unit 10, an adhesive unit 52 deposits adhesive 56 upon the inner surface 32 of the side portions 36, 38 of each of the first and second webs 26, 28. The spring unit 10 having the first and second webs 26, 28 located there against is then passed to a folding unit 54 which folds the reverse side 32 of the side portions 36, 38 of each of the first and second webs 26, 28 with the adhesive 56 deposited thereon against the reverse side 32 of the respective center portion 34 and against the top and bottom turns 22, 24 of the coil springs 20 comprising the longitudinal margins of the spring unit 10.

Figure 3:
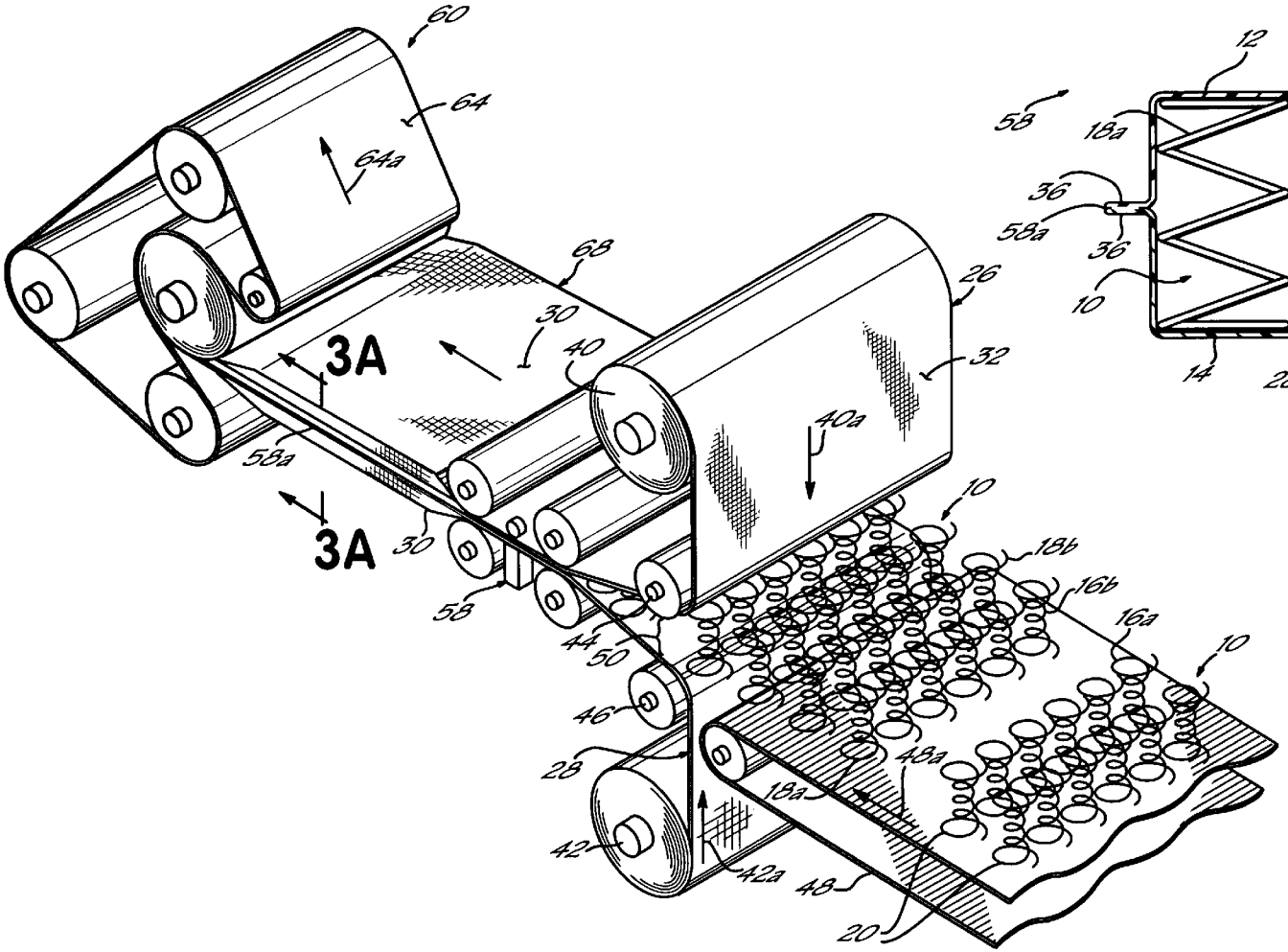
FIG. 3 is a perspective view of a second preferred embodiment of the present inventive method.
Figure 4:
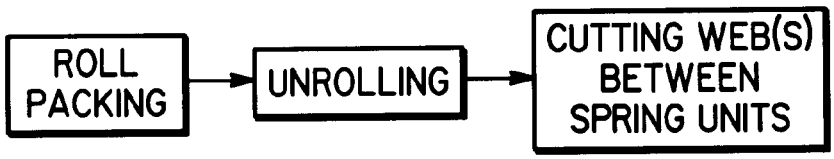
FIG. 4 is a flow chart of a portion of the method of the present invention.

As seen in FIGS. 3 and 3A, in a second preferred embodiment, after the first and second webs 26, 28 are located against respective first and second surfaces 12, 14 of the spring unit 10, the spring unit 10 with the first and second webs 26, 28 located there against is passed to a welding unit 58 whereat the reverse sides 32 of the opposed side portions 36 of the first web 26 are welded to the adjacent side portions 36 of the second web 28. While only side portions 36 of the first and second webs 26, 28 are shown in FIG. 3A, it will be understood that side portions 38 are a mirror image thereof and are welded in a similar manner. The welding together of the first and second webs 26, 28 may be accomplished by any suitable welding process for woven or non-woven materials known in the art, e.g., ultrasonic or radio frequency welding, to create a weld 58*a*, as seen in FIG. 3A.

Figure 2:
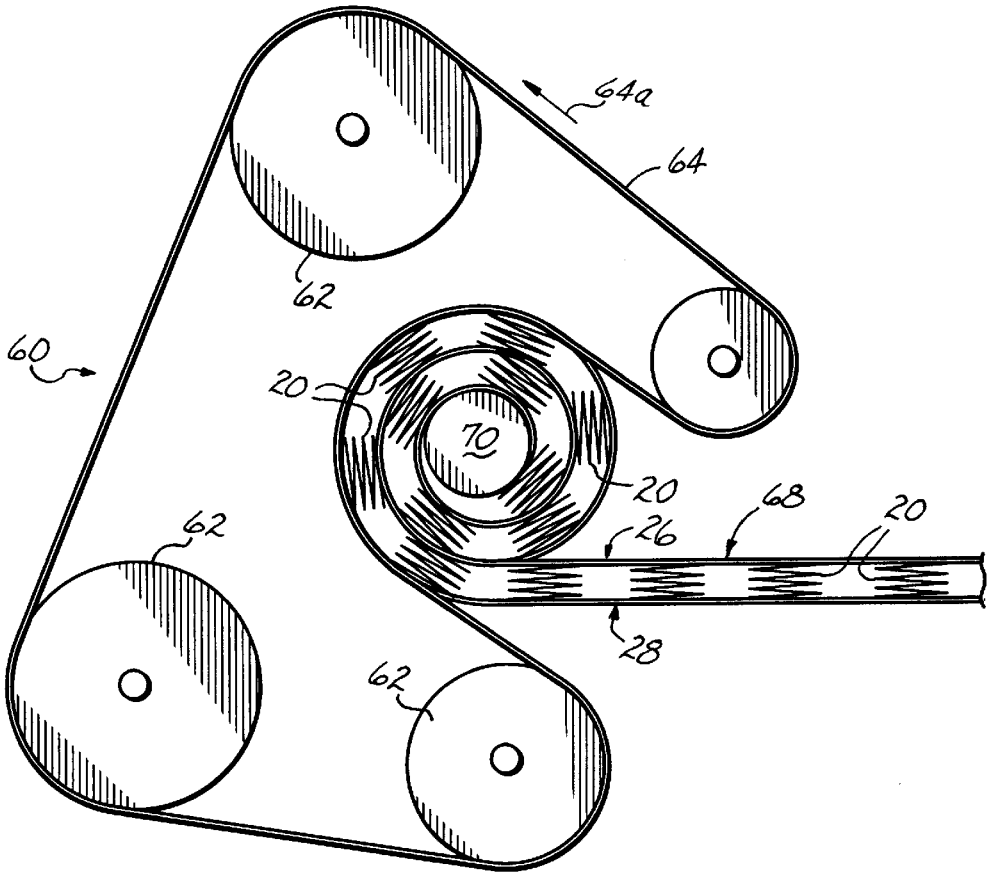
FIG. 2 is a side view of a bedding product being roll-packed.

After the first and second webs 26, 28 have been fixedly located against the first and second surfaces 12, 14 of the spring unit 10 by either the gluing or the welding methods as described above, the spring unit 10 with the first and second webs 26, 28 located there against is then passed to a roll-packing machine 60 as best seen in FIG. 2. The roll-packing machine 60 has a plurality of rollers 62 which carry thereon an endless belt 64 traveling in a direction indicated by directional arrow 64a. The spring unit 10 with the first and second webs 26, 28 attached permanently thereto comprises a bedding or seating product 68 ready for shipment, for example, from a spring manufacturer to a mattress or seat manufacturer. As the product 68 is wound about a core 70 upon which it is to be transported, the roll-packing machine 60 compresses the bedding or seating product 68 so that plural bedding or seating products 68 may be so packaged.

When the packaged roll of bedding or seating units 68 arrive at the mattress or seat manufacturer's facility, all that the manufacturer need do is unroll the packaged products from the roll and transversely cut the webs 26, 28 at locations between the spaced spring units 10. The resulting bedding or seating product 68 having the insulator material permanently secured to its top and bottom sides is than ready for application of the appropriate padding and upholstery materials to complete the mattress or seat.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

I claim:

1. A method of packaging a plurality of spring units, each spring unit comprising a plurality of coil springs, each of said coil springs having a top turn and a bottom turn, said top turns of said coil springs defining a generally planar first surface and said bottom turns of said coil springs defining a generally planar second surface, said method comprising the steps of:

providing first and second webs of insulator material, each of said webs of insulator material being adapted to separate said spring units from padding to be applied to said spring units, each of said webs of insulator material having a width including a pair of opposing side portions and a center portion;

locating said first and second webs against said first and second surfaces, respectively, of said spring units;

permanently securing said first and second webs to said spring units; and roll-packing said spring units and said webs of insulator material such that said spring units are at least partially compressed and upon unrolling, said webs of insulator material remain permanently connected to said spring units.

2. The method of claim 1 wherein said step of permanently securing said first and second webs to said spring units comprises folding said side portions of said first and second webs around said top and bottom turns of outermost coil springs of said springs units and securing said side portions to said central portions of said webs.

3. The method of claim 2 wherein said step of securing said side portions to said center portions of said webs comprises bonding said side portions to said respective center portions of said webs.

4. The method of claim 1 further comprising the steps of:

providing first and second web rolls carrying said first and second webs of insulator material, respectively; and passing said first and second webs of insulator material between respective first and second rollers before locating said first and second webs against said first and second surfaces, respectively, of said spring units.

5. The method of claim 1 further comprising the step of unrolling said spring units, said spring units remaining connected to said webs of insulator material.

6. The method of claim 5 further comprising the step of cutting said webs of insulator material between adjacent spring units.

7. A method of packaging a plurality of spring units, each of said spring units having a generally planar first surface, a generally planar second surface, a longitudinal dimension and a transverse dimension, said method comprising the steps of:

providing first and second web rolls of insulator material, each of said webs of insulator material having inner and outer surfaces and opposed side edges defining a width of said web, each of said webs of insulator material being adapted to separate said spring units from padding to be applied to said spring units and having opposed side portions and a central portion between said side portions across said width of said web;

passing said first and second webs of insulator material past said first and second surfaces of said spring units;

locating said first and second webs against said first and second surfaces, respectively, of said spring units;

permanently securing said side portions of said first web to said side portions of said second web such that said spring units are sandwiched between said webs of insulator material; and roll-packing said spring units and said first and second webs of insulator material such that said spring units are at least partially compressed and upon rolling said spring units, said webs of insulator material remain permanently secured to each other.

8. The method of claim 7 further comprising the step of unrolling said spring units.

9. The method of claim 8 further comprising the step of cutting said webs of insulator material between adjacent spring units.

10. The method of claim 7 wherein said step of securing said side portions of said first web to said side portions of said second web comprises adhesively bonding said side portions of said webs to each other.

11. The method of claim 7 wherein said step of securing said side portions of said first web to said side portions of said second web comprises welding said inner surface of said side portions of said first web to said inner surface of said side portions of said second web.

12. The method of claim 8 further comprising the step of passing said first and second webs of insulator material between parallel rollers before passing said webs past said first and second surfaces of said spring units.

13. The method of claim 12 wherein said parallel rollers rotate in opposite directions.

14. The method of claim 7 wherein said web rolls rotate in opposite directions.

15. A method of packaging a plurality of spring units, each of said spring units comprising a plurality of coil springs, each of said coil springs having a top turn and a bottom turn, each of said spring units having a generally planar first surface defined by said top turns and a generally planar second surface defined by said bottom turns, a longitudinal dimension and a transverse dimension, said method comprising the steps of:

providing first and second web rolls of insulator material, each of said web rolls comprising a web of insulator material carried upon a core and each of said webs of insulator material having inner and outer surfaces and opposed side edges defining a width of said web, said web being wider than said transverse dimensions of said spring units, each of said webs of insulator material being adapted to separate said spring units from padding to be applied to said spring units and having opposed side portions and a central portion between said side portions;

passing said first and second webs of insulator material over said first and second surfaces of said spring units, respectively, said spring units being oriented such that said transverse dimensions of said spring units are generally perpendicular to said opposed side edges of said webs;

locating said first and second webs against said first and second surfaces, respectively, of said spring units;

folding said side portions of said first and second webs around said top and bottom turns, respectively, of said coil springs along said longitudinal dimensions of said spring units so that each of said side portions of said first and second webs is folded back upon said respective center portion of each of said first and second webs;

permanently securing said side portions of said first and second webs to said central portions of said first and second webs, and roll-packing said spring units with said first and second webs of insulator material secured to said spring units such that said spring units are at least partially compressed and upon unrolling said spring units said webs of insulator material remain permanently secured to said spring units.

16. The method of claim 15 further comprising the step of unrolling said spring units.

17. The method of claim 16 further comprising the step of cutting said webs of insulator material between adjacent spring units.

18. A method of packaging plural spring units, each of said spring units having a generally planar first surface, a generally planar second surface, a longitudinal dimension defined between opposed end surfaces, and a transverse dimension defined between side surfaces, said method comprising the steps of:

providing first and second web rolls of insulator material, each of said web rolls comprising a web of insulator material carried upon a core, each of said webs of insulator material being adapted to separate said spring units from padding to be applied to said spring units, each of said webs of insulator material also having inner and outer surfaces and opposed side edges defining a width of said web, said width being larger than said transverse dimensions of said spring units, each of said webs having opposed side portions and a central portion between said side portions;

passing said first and second webs of insulator material past said first and second surfaces of said spring units, respectively, said spring units being oriented such that said end surfaces of said spring units are generally perpendicular to said opposed side edges of said webs;

locating said first and second webs against said first and second surfaces, respectively, of said spring units;

locating said inner surface of said side portions of said first web against said inner surface of said side portions of said second web;

permanently securing said side portions of said webs together, whereby said spring units with said first and second webs secured thereto constitute bedding products; and roll-packing said bedding products whereby said spring units are at least partially compressed and upon unrolling said bedding products said webs of insulator material remain permanently secured to each other.

19. A method of packaging a plurality of spring units, each spring unit comprising a plurality of coil springs, each of said coil springs having a top turn and a bottom turn, said top turns of said coil springs defining a generally planar top surface and said bottom turns of said coil springs defining a generally planar bottom surface, said method comprising the steps of:

providing first and second webs of insulator material, each of said webs having a generally uniform width including a pair of opposing side portions and a center portion, and inner and outer surfaces, each of said webs being adapted to separate said spring units from padding to be applied to said spring units;

locating said first and second webs against said top and bottom surfaces, respectively, of said spring units such that said inner surfaces of said webs abut said spring units;

folding said side portions of said webs around said top and bottom turns of select coil springs of said spring units, permanently securing said side portions of said webs to said central portions of said webs to secure said webs to said spring units; and roll-packing said spring units such that said spring units are at least partially compressed, said spring units being connected to each other by said webs.

20. The method of claim 19 further comprising the steps of:

providing first and second web rolls carrying said first and second webs of insulator material, respectively; and passing said first and second webs of insulator material between respective first and second rollers before locating said first and second webs against said first and second surfaces, respectively, of said spring units.

21. A method of packaging a plurality of spring units, each spring unit comprising a plurality of coil springs, each of said coil springs having a top turn and a bottom turn, said top turns of said coil springs defining a generally planar top surface and said bottom turns of said coil springs defining a generally planar bottom surface, said method comprising the steps of:

providing a web of insulator material, said web of insulator material having a pair of side portions, a center portion between said side portions, and inner and outer surfaces;

covering one of the top and bottom surfaces of the spring units with said web of insulator material;

depositing adhesive upon the inner surfaces of the side portions of said web of insulator material;

folding said side portions of said web of insulator material around said top and bottom turns of select coil springs of said spring units, allowing said adhesive to dry thereby permanently securing said side portions of said web to said central portion of said web and secure said web to said spring units; and roll-packing said spring units connected to each other by said web such that said spring units are at least partially compressed and upon unrolling said web of insulator material remains connected to said spring units.

22. The method of claim 21 wherein said spring units are oriented such that opposed side surfaces of said spring units are parallel opposed side edges of said web of insulator material.

23. A method of packaging a plurality of spring units, each spring unit comprising a plurality of coil springs, each of said coil springs having a top turn and a bottom turn, said top turns of said coil springs defining a generally planar top surface and said bottom turns of said coil springs defining a generally planar bottom surface, said method comprising the steps of:

moving said springs units into a space between a pair of guide rollers, providing first and second webs of insulator material, each of said webs of insulator material being adapted to separate said spring units from padding to be applied to said spring units and having a pair of side portions, a center portion between said side portions, and inner and outer surfaces;

passing said webs of insulator material between said guide rollers;

covering the top and bottom surfaces of the spring units with said webs of insulator material;

depositing adhesive upon the inner surfaces of the side portions of each of said webs of insulator material;

folding said side portions of said webs of insulator material around said top and bottom turns of select coil springs of said spring units, allowing said adhesive to permanently secure said side portions of said webs to said central portions of said webs, thereby securing said webs to said spring units; and roll-packing said spring units connected to each other with said webs such that said units are at least partially compressed.

24. A method of packaging a plurality of spring units, each spring unit comprising a plurality of coil springs, each of said coil springs having a top turn and a bottom turn, said top turns of said coil springs defining a generally planar top surface and said bottom turns of said coil springs defining a generally planar bottom surface, said method comprising the steps of:

providing a web of insulator material adapted to separate said spring units from padding to be applied to said spring units, said web having a generally uniform width including a pair of opposing side portions and a center portion, locating said web against one of said top and bottom surfaces of said spring units;

folding said side portions of said web around end turns of select coil springs of said spring units, permanently securing said side portions of said web to said central portion of said web to secure said web to said spring units; and roll-packing said spring units and said web of insulator material such that said spring units are at least partially compressed, said spring units being connected to each other by said web such that upon unrolling said spring units, said web of insulator material remains connected to said spring units.

* * * * *

UNITED STATES PATENT AND TRADEMARK OFFICE

CERTIFICATE OF CORRECTION

PATENT NO. : 6,357,209 B1 
DATED : March 19, 2002
INVENTOR(S) : Niels S. Mossbeck and Thomas J. Wells It is certified that error appears in the above-identified patent and that said Letters Patent is hereby corrected as shown below:

Column 3,
Lines 45-58, "inner surface 32, the or inner surface" should read -- inner surface 32, the inner surface 32 --.
Line 25, "webs 20, 26, 28 has" should read -- webs 26, 28 has --.

Column 5,
Lines 2-4, "Therefore, I desire to be limited only by the scope of the following claim and equivalents thereof; I claim:" should read -- Therefore, we desire to be limited only by the scope of the following claim and equivalents thereof. We claim --.
Line 31, "of said springs units and" should read -- of said spring units and --.

Column 6,
Line 23, "The method of claim 8 further" should read -- The method of claim 7 further --.

Column 8,
Line 51, "moving said springs units into a" should read -- moving said spring units into a --.

Signed and Sealed this

Seventeenth Day of September, 2002

*Attest:*

*Attesting Officer*

JAMES E. ROGAN
*Director of the United States Patent and Trademark Office*